US008568171B2

(12) United States Patent
Yang et al.

(10) Patent No.: US 8,568,171 B2
(45) Date of Patent: Oct. 29, 2013

(54) STACKED ELECTRICAL CONNECTOR

(75) Inventors: Hongwen Yang, Shanghai (CN); Huibin Li, Shanghai (CN); Wei Yao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 29 days.

(21) Appl. No.: 13/306,259

(22) Filed: Nov. 29, 2011

(65) Prior Publication Data

US 2012/0135636 A1 May 31, 2012

(30) Foreign Application Priority Data

Nov. 29, 2010 (CN) ..... 2010 2 0642791 U

(51) Int. Cl.
*H01R 13/648* (2006.01)

(52) U.S. Cl.
USPC ..... 439/607.27

(58) Field of Classification Search
USPC ..... 439/607.27, 607.35, 607.36, 607.07, 439/660, 218, 217, 939, 540.1, 541.5
See application file for complete search history.

(56) References Cited

U.S. PATENT DOCUMENTS

| | | | | |
|---|---|---|---|---|
| 6,139,367 | A * | 10/2000 | Yeh | 439/607.17 |
| 6,827,610 | B2 * | 12/2004 | Lin | 439/607.37 |
| 7,811,110 | B2 * | 10/2010 | He et al. | 439/218 |
| 7,922,535 | B1 * | 4/2011 | Jiang et al. | 439/607.35 |
| 8,011,956 | B1 * | 9/2011 | Yang et al. | 439/589 |
| 8,070,516 | B2 * | 12/2011 | Chiang | 439/607.27 |
| 8,292,674 | B1 * | 10/2012 | Yang et al. | 439/660 |

* cited by examiner

*Primary Examiner* — Alexander Gilman
(74) *Attorney, Agent, or Firm* — Barley Snyder

(57) ABSTRACT

A stacked electrical connector having an insulation body, a plurality of contacts, an external case, and an internal case. The insulation body includes a pair of plugs and a separation member disposed between the pair of plugs for separating the pair of plugs. The plurality of contacts are disposed on the pair of plugs. The external case encloses the insulation body, while the internal case encloses the separation member. The internal case has at least two support legs extending out of the external case from two sides of the internal case respectively, to secure the electrical connector on a circuit board. By providing the support legs on the internal case, the material cost of the connector can be reduced and the workability of the support legs can be improved.

12 Claims, 7 Drawing Sheets

STACKED ELECTRICAL CONNECTOR

CROSS-REFERENCE TO RELATED APPLICATION

This application claims the benefit under 35 C. §119(a)-(d) of Chinese Patent Application No. 201020642791.5 filed on Nov. 29, 2010.

FIELD OF THE INVENTION

The present invention relates to an electrical connector, more particularly, relates to a stacked electrical connector.

BACKGROUND

In various electrical connectors, there are some electrical connectors that have sinking plates. In the electrical connector with sinking plates, a portion of the structure of the electrical connector passes through an opening of a PCB and extends below the surface of the PCB. The electrical connector generally includes an external case, an insulation body disposed in the external case, and an internal case mounted on the insulation body. At least one row of contacts is assembled on the insulation body for transmitting signals between the PCB and an external apparatus.

In the above known electrical connector, generally, the know electrical connector is formed with supporting legs on both sides of the external case. The supporting legs are supported on both sides of the opening of the PCB when the electrical connector is assembled on the PCB, for supporting the connector, especially for supporting the sinking plates thereof. The supporting legs integrally extend from the front end of the external case, and are folded backward and then protrude downward to the PCB.

However, since the supporting legs are formed on the external case of a large dimension, it increases the material and the cost to manufacture the supporting legs, and it is difficult to accurately control the position of the supporting legs relative to the external case.

SUMMARY

The present invention has been made to overcome or alleviate at least one aspect of the above mentioned disadvantages. Accordingly, it is an object of the present invention to provide a stacked electrical connector having an insulation body, a plurality of contacts, an external case, and an internal case. The insulation body includes a pair of plugs and a separation member disposed between the pair of plugs for separating the pair of plugs. The plurality of contacts are disposed on the pair of plugs. The external case encloses the insulation body, while the internal case encloses the separation member. The internal case has at least two support legs extending out of the external case from two sides of the internal case respectively, to secure the electrical connector on a circuit board. By providing the support legs on the internal case, the material cost of the connector can be reduced and the workability of the support legs can be improved.

BRIEF DESCRIPTION OF THE DRAWINGS

The above and other features of the present invention will become more apparent by describing in detail embodiments thereof with reference to the accompanying drawings, in which.

DETAILED DESCRIPTION OF THE EMBODIMENT(S)

Figure 1:
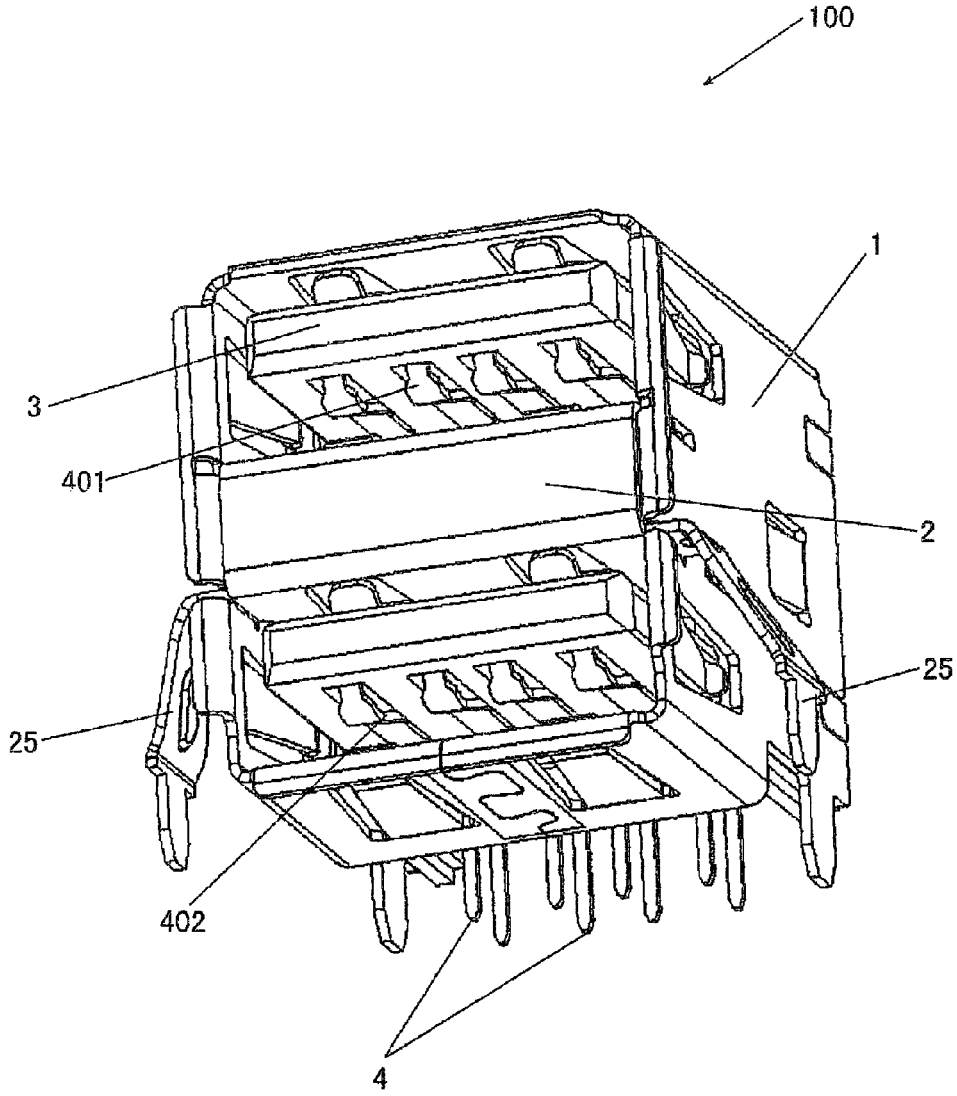
FIG. 1 is a perspective view of an assembled electrical connector according to the invention.

The embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

An embodiment of the present invention will be described in detail with reference to FIGS. 1-7.

Figure 2:
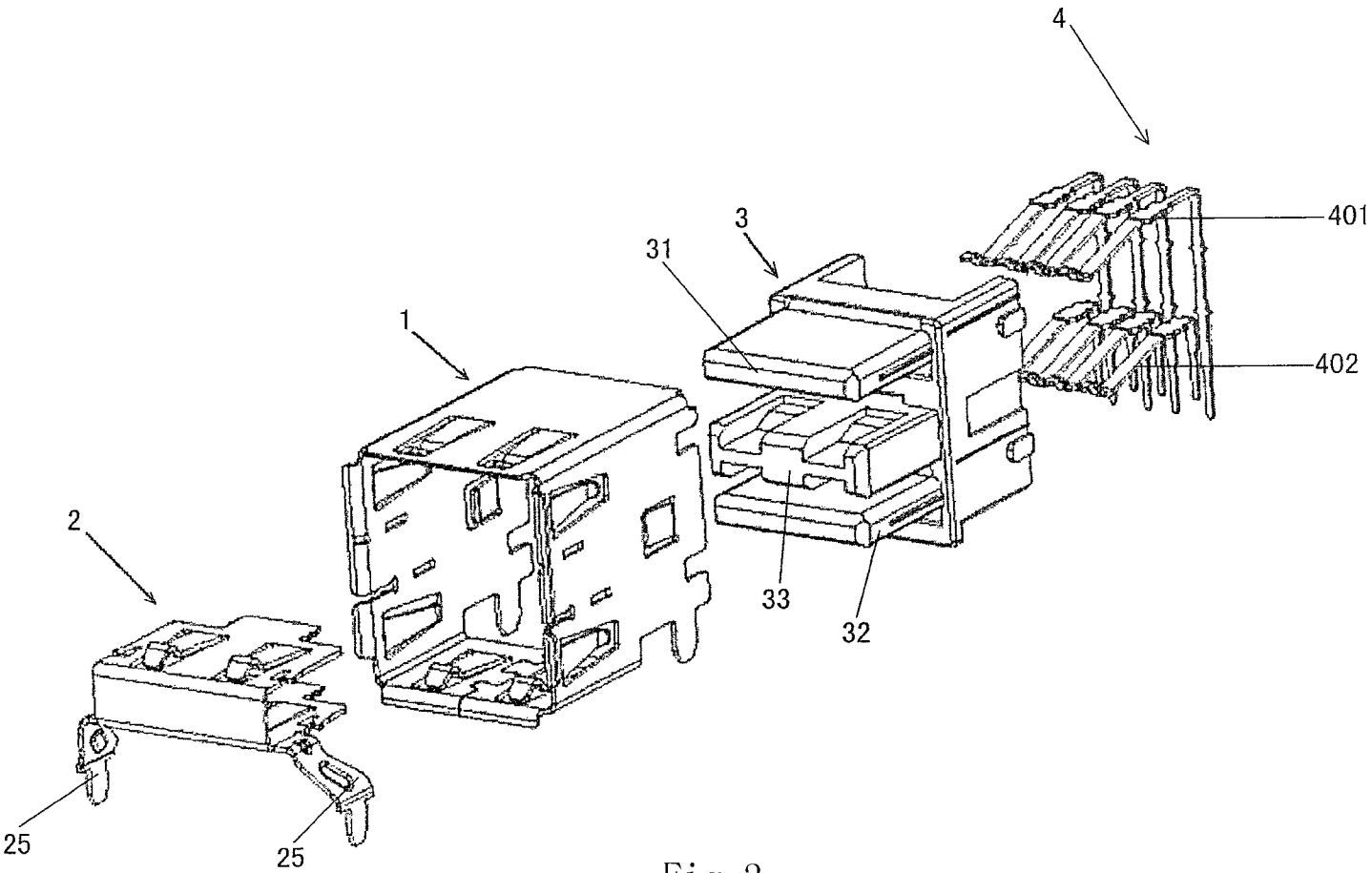
FIG. 2 is an exploded view of the electrical connector shown in FIG. 1.
Figure 3:
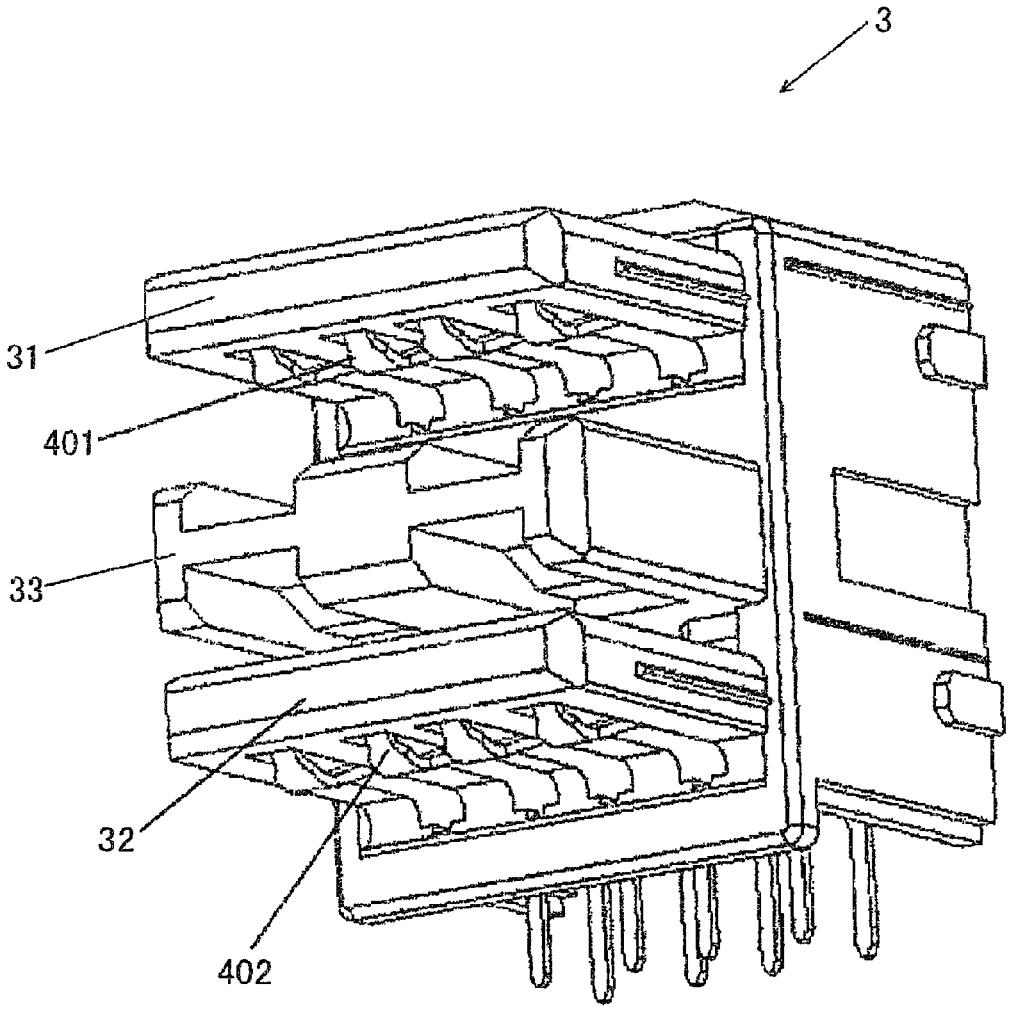
FIG. 3 is a perspective view of an insulation body and contacts of the electrical connector shown in FIG. 2.

As shown in FIGS. 1-3, a stacked electrical connector 100 according to the invention includes an external case 1, an internal case 2, an insulation body 3, and contacts 4. The external case 1 encloses the insulation body 3. The internal case 2 is mounted on the insulation body 3 and is disposed in the external case 1. The internal case 2 has two supporting legs 25. The two supporting legs 25 extend from both sides of the internal case 2 respectively and pass through the external case 1 to be fixed to a circuit board. The contacts 4 are fitted in the insulation body 3 for transmitting signals between the circuit board (for example, PCB) and an external apparatus. As shown in FIG. 3, the contacts 4 include two rows of contacts 401, 402.

The structure of the insulation body 3 and the assembled structure of the insulation body 3 with the contacts 4 and the internal case 2 will be described in detail according to FIGS. 2-3. The insulation body 3 mainly includes a first plug 31, a second plug 32, and a separation member 33 disposed between the first and second plugs 31, 32 for separating the two plugs 31, 32. The first and second plugs 31, 32 are configured to be inserted into a respective electrical connector plug (not shown). Furthermore, each of the first and second plugs 31, 32 is configured to secure one of the two rows of contacts 401, 402 for electrically connecting to the respective electrical connector plug to achieve signal transmission between the circuit board and the external apparatus. The internal case 2 encloses the separation member 33.

FIG. 3 shows an embodiment of the insulation body 3, and for those skilled in this art, it should be appreciated that the insulation body 3 may have different structures, for example, the insulation body 3 may include two or more plugs for mounting two or more rows of contacts thereon.

Figure 4:
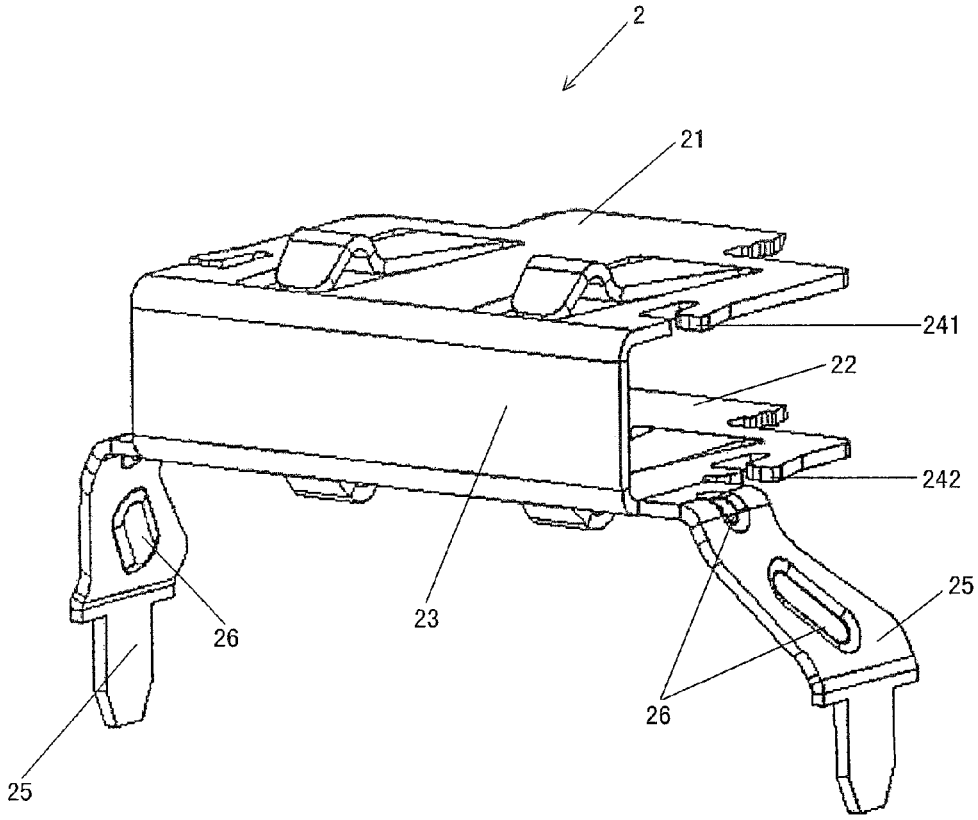
FIG. 4 is an enlarged perspective view of an internal case of the electrical connector shown in FIG. 1.

The structure of the internal case 2 of FIG. 1 will be described in detail with reference to FIGS. 4-5. As shown in FIG. 4, an embodiment of the internal case 2 is a U-shaped sheet member having a first sheet portion 21, a second sheet portion 22 and a connection portion 23 connecting the first and second sheet portions 21, 22. The supporting legs 25 extend from front end portions of both sides of the second sheet portion 22, respectively. In addition, the first sheet portion 21 is formed with finger pieces 241 at both sides thereof respectively, and the second sheet portion 22 is formed with finger pieces 242 at both sides thereof respectively. The finger pieces 241, 242 are elastic protruding pieces formed by cutting L-shaped grooves in both sides of the first and second sheet portions 21, 22. Furthermore, an enforcing rib 26 is formed on the supporting leg 25 to strengthen the supporting leg 25.

Figure 5:
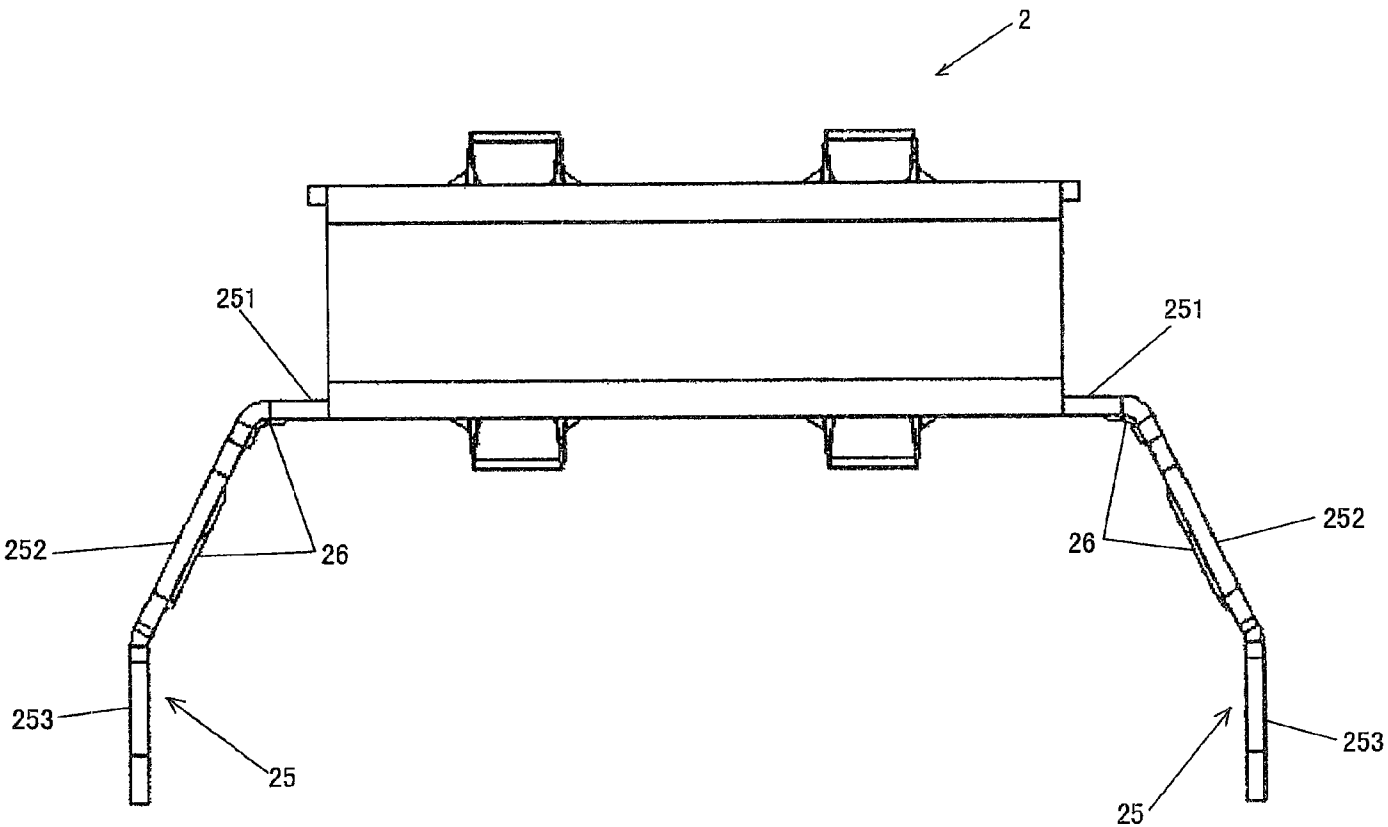
FIG. 5 is a front view of the internal case shown in FIG. 4.

As shown in FIG. 5, the supporting leg 25 includes a horizontal plate portion 251 horizontally extending from the internal case 2, a first inclined section 252 folded from the horizontal plate portion 251, and a second inclined section 253 folded from the first inclined section 252 to extend in a substantively vertical direction. The horizontal plate portion 251 extends by about 1 mm~2 mm. The folded angle of the first inclined section 252 from the horizontal plate portion 251 may be 115~120 degrees. The first inclined section 252 may slantingly extend by a vertical distance of about 2 mm~5 mm. The folded angle of the second inclined section 253 from the first inclined section 252 may be 150~155 degrees. The second inclined section 253 extends to the PCB in the substantively vertical direction and is inserted into a hole in the PCB. But, the size of the supporting leg may be modified according to various electrical connectors. As shown in FIGS. 4-5, the enforcing ribs 26 are formed along a folded portion between the horizontal plate portion 251 and the second inclined section 253, and in particular along a middle portion of the first inclined section 252 respectively.

The assembled structure of the internal case 2 and the external case 1 will be described in detail with reference to FIGS. 6-7.

Figure 6:
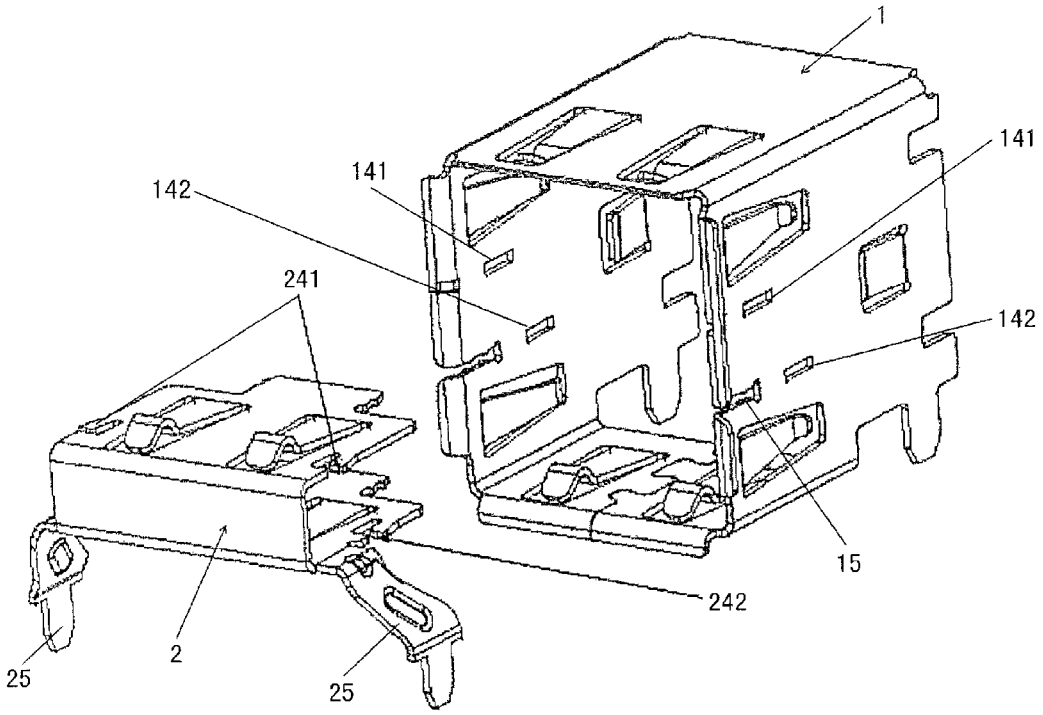
FIG. 6 shows an exploded view of the internal case and the external case according to the invention.

As shown in FIG. 6, a plurality of receiving grooves 15 are formed in the front end of both sides of the external case 1 for receiving the supporting legs 25 of the internal case 2, respectively. Specifically, the horizontal plate portions 251 of the supporting legs 25 are received in the receiving grooves 15. In addition, a plurality of finger piece receiving passageways 141, 142 are positioned on both sides of the external case 1, two holes 142 of which are located at a position behind and separate from the receiving grooves 15 in a horizontal direction, for engaging with the finger pieces 242 of the second sheet portion 22 of the internal case 2, and the other two finger piece receiving passageways 141 of which are located at a position corresponding to the first sheet portion 21 of the internal case 2, for engaging with the finger pieces 241 of the first sheet portion 21 of the internal case 2.

Furthermore, when the internal case 2 is inserted into the external case 1, with the supporting legs 25 gradually entering the receiving grooves 15, the elastic sheets of the finger pieces 241, 242 are compressed by the side wall of the external case 1. When the supporting legs 25 are pushed into the bottom of the receiving grooves 15, the elastic sheets of the finger pieces 241, 242 enter the finger piece receiving passageways 141, 142 in the side walls of the external case 1 respectively and elastically expanded outward to abut against the front edges of the finger piece receiving passageways 141, 142. Thereby, the position of the internal case 2 in the external case 1 may be reliably determined by the receiving grooves 15 and finger piece receiving passageways 141, 142.

Figure 7:
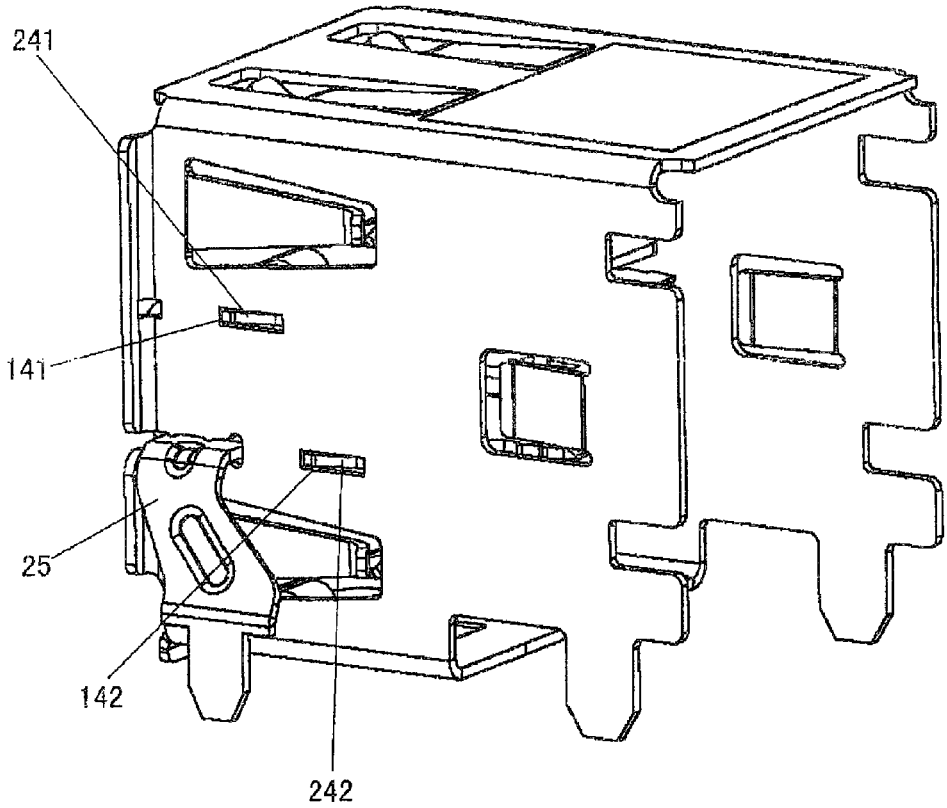
FIG. 7 shows a perspective view of an assembling structure of the internal case and the external case according to the invention.

FIG. 7 shows a perspective view of an assembling structure of the internal case 2 and the external case 1. As shown in FIG. 7, the supporting legs 25 is received in the receiving grooves 15, and the finger pieces 241, 242 are received in the finger piece receiving passageways 141, 142 respectively.

In addition to the engaging members shown in FIGS. 6-7, it is appreciated for those skilled in this art that other engaging members may be used to secure the internal case 2 and the external case 1. For example, the finger pieces 241 may be provided on the external case 1, and the holes may be formed in the internal case 2. In addition, other engaging members, such as screws and bolts, may be used to engage and secure the internal case 2 and the external case 1. The external case 1 and the internal case 2 may be formed by punching a metal material, such as stainless steel, copper, and so on. The insulation body 3 may be a molded plastic piece. The contacts 4 may be made of a conductive material, for example, phosphor bronze.

In the electrical connector according to the invention, the supporting legs 25 are formed on the internal case 2 that is less than the external case 1 in size. Therefore, it may avoid producing a great amount of waste material in manufacturing the supporting legs 25 so that the material cost can be saved. In addition, according to an embodiment of the present invention, the supporting legs 25 may be easily manufactured. Furthermore, with the assembled structure of the internal case 2 and the external case 1, it may accurately locate the position of the supporting legs 25 in the fore-and-aft direction of the connector, improving the accuracy of assembling the connector.

Although several embodiments have been shown and described, it would be appreciated by those skilled in the art that various changes or modifications may be made in these embodiments without departing from the principles and spirit of the disclosure, the scope of which is defined in the claims and their equivalents.

As used herein, an element or step recited in the singular form and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A stacked electrical connector, comprising:

an insulation body having a pair of plugs and a separation member disposed between the pair of plugs for separating the two plugs;

a plurality of contacts disposed on each of the pair of plugs;

an external case enclosing the insulation body; and an internal case enclosing the separation member, the internal case having a plurality of support legs extending from two sides of the internal case and out of the external case to be fixed to a circuit board.

2. The stacked electrical connector according to claim 1, wherein the internal case is a U-shaped sheet having a first sheet portion, a second sheet portion and a connection portion connecting the first sheet portion and the second sheet portion.

3. The stacked electrical connector according to claim 2, wherein the supporting legs extend from a portion of both sides of one of the first sheet portion and the second sheet portion, respectively.

4. The stacked electrical connector according to claim 3, further comprising a plurality of receiving grooves disposed in the external case for receiving the supporting legs.

5. The stacked electrical connector according to claim 3, further comprising a plurality of first engaging members disposed on both sides of the first sheet portion and the second sheet portion, respectively.

6. The stacked electrical connector according to claim 5, further comprising a plurality of second engaging members disposed on the external case and engaged with the plurality of first engaging members.

7. The stacked electrical connector according to claim 6, wherein one of the plurality of first engaging members is a finger piece and the second engaging member is a finger piece receiving passageway.

8. The stacked electrical connector according to claim 7, wherein the finger piece is an elastic protruding member formed by cutting an L-shaped groove in both sides of the first sheet portion and the second sheet portion.

9. The stacked electrical connector according to claim 1, wherein each of the plurality of supporting legs includes a horizontal plate portion horizontally extending from the internal case, a first inclined section folded from the horizontal plate portion, and a second inclined section folded from the first inclined section to extend in a substantively vertical direction.

10. The stacked electrical connector according to claim 1, further comprising a rib disposed on the supporting leg.

11. The stacked electrical connector according to claim 10, wherein the rib is disposed along a folded portion between the horizontal plate portion and the second inclined section.

12. The stacked electrical connector according to claim 11, wherein the rib is disposed along a middle portion of the first inclined section.

* * * * *